US007117619B1

(12) United States Patent
Huber

(10) Patent No.: US 7,117,619 B1
(45) Date of Patent: Oct. 10, 2006

(54) BANNER SCORING DEVICE

(76) Inventor: John Jerome Huber, 10910 S. Quebec Pl., Tulsa, OK (US) 74137

( * ) Notice: Subject to any disclaimer, the term of this patent is extended or adjusted under 35 U.S.C. 154(b) by 1 day.

(21) Appl. No.: 10/717,527

(22) Filed: Nov. 21, 2003

(51) Int. Cl.
*G09F 11/04* (2006.01)

(52) U.S. Cl. ..... 40/495; 40/604; 116/309; 116/318; 116/222; 273/DIG. 26

(58) Field of Classification Search ..... 40/495, 40/604, 603; 116/309, 316, 318, 222, 224; 273/26

See application file for complete search history.

(56) References Cited

U.S. PATENT DOCUMENTS

| | | | | |
|---|---|---|---|---|
| 3,455,273 | A | 7/1969 | Willingham, Jr. | |
| 4,045,788 | A | 8/1977 | Castelli | |
| 4,164,910 | A * | 8/1979 | Feiler | 116/225 |
| 4,165,710 | A * | 8/1979 | Gaetano | 116/223 |
| 4,280,291 | A | 7/1981 | Maynes | |
| 4,354,282 | A * | 10/1982 | Langdon | 2/115 |
| 4,557,215 | A * | 12/1985 | Petersson | 116/222 |
| 4,831,956 | A | 5/1989 | Thater | |
| 4,937,962 | A * | 7/1990 | Hornblad | 406/617 |
| 5,016,372 | A * | 5/1991 | Gold | 40/591 |
| 5,337,907 | A | 8/1994 | McKenzie | |
| 5,348,309 | A * | 9/1994 | Queiros | 473/467 |
| 5,418,517 | A * | 5/1995 | Matherne et al. | 340/323 R |
| 5,615,636 | A | 4/1997 | Gustafson | |
| 5,664,780 | A * | 9/1997 | Bricker | 273/239 |
| 6,029,830 | A | 2/2000 | Manookian | |
| 6,041,934 | A * | 3/2000 | Alexson | 206/579 |
| 6,053,340 | A | 4/2000 | Cameron | |
| 6,216,374 | B1 * | 4/2001 | Lawrence | 40/604 |

* cited by examiner

*Primary Examiner*—Gary C. Hoge

(57) ABSTRACT

A two-sided, multi-sport scoring banner 30 consisting of a plurality of flexible scoring elements 44A, 44B, 44C, 44D sandwiched between a front face 32 and a back face 34. A set of scoring symbols 44A, 44B, 44C, 44D selectively positioned and uniformly spaced upon the scoring element to allow the score of a competitive event to be displayed through a plurality of windows 48, 50, 52, 54 formed into the front and back faces of the scoring banner. A plurality of utility storage pockets 90, a plurality of equipment storage loops 110 and a plurality of hooks 120 attached to the scoring banner to facilitate the organization of a variety of sport equipment items. A team insignia 74, a home and visitor title 76, 78 and a plurality of advertisement signs 130 printed on or attached to the scoring banner's two faces. In one embodiment a plurality of linear pockets 60, 62, 64, 66 are included within the scoring banner to facilitate the use and storage of a plurality of ground stakes or rods 58. The scoring banner, in all of its embodiments, having the means to be attached to a variety of structures, display a team's insignia, easily maintain the score of the sporting event as well as be rolled up and secured into a compact cylindrical configuration for storage and transport.

1 Claim, 13 Drawing Sheets

BANNER SCORING DEVICE

CROSS-REFERENCE TO RELATED APPLICATIONS

Not applicable

FEDERALLY SPONSORED RESEARCH

Not Applicable

SEQUENCE LISTING OR PROGRAM

Not Applicable

BACKGROUND OF INVENTION

1. Field of Invention

This invention relates to scoring devices that are portable, self contained and capable of being used in a wide variety of sporting events and venues.

2. Background of the Invention

Team banners are a popular choice for youth and adult sporting teams providing a means to display their team insignia in any sporting venue. Banners are easily attached and displayed on a variety of surfaces while capable of being rolled up and easily stored in an equipment bag or car trunk.

In addition, every sports team relies on the ability to keep an up to date score. The ability to display this score is a critical part of the enjoyment of every participant involved in the sporting event, including players, coaches, parents and spectators. In many sporting events, particularly youth sporting events, scoreboard displays are not available for common viewing. The need for distant viewing displays requires large rigid structures requiring a high degree of complexity in assembly, storage, maintenance and transportability. These large, permanent and expensive scoreboards are often not a practical solution for many youth sport organizations. Therefore scores are often maintained with pencil and paper which can only be viewed by the individual scorekeeper. A participant is forced to keep his or her own score, either by using memory, using their own pencil and paper or most cases repeatedly asking the scorekeeper what the current score is. Therefore inventors have created several approaches to solving this problem by designing small portable scoring devices. They have, however, failed in developing a scoring device that meets the lightweight, flexible, compactable and storable benefits of a banner.

U.S. Pat. No. 4,045,788 to Castelli (1977) discloses an all purpose one-sided portable electronic scoreboard with a self contained carrying case of rigid material, however this scoreboard requires the use of an external power source forcing the playing field to provide a 120 V AC supply or a portable gasoline generator. The rigid self-contained carrying case limits the scoreboard's compact portability. U.S. Pat. No. 4,280,291 to Maynes (1981) discloses a two-sided portable scoreboard with a pair of overlapping disks sandwiched between a front and rear plate, however the rigidity of the disclosed front and back plates and disks prevents flexibility and compact portability. Maynes also requires a complex array of display attachments required for use in different venues, further restricting its compact portability. U.S. Pat. No. 5,615,636 to Gustafson (1997) discloses a portable scoreboard with an inverted-U-shaped mounting frame, incorporating a plurality of cards having indicia and arranged in at least three stacks with the cards having a front face and a back face. This scoreboard requires over eighty components in its basic design, a large U-shaped rigid frame plus a complexity of display attachments for alternative venues thus preventing flexible compact portability.

U.S. Pat. No. 6,041,934 to Alexson (2000) discloses a portable scoring apparatus comprising of a carrying case formed of two half sections joined together by a flexible connecting section however the scoring apparatus does not provide the benefits of a banner display of a team insignia in a size that could be easily viewable while remaining compact and portable. U.S. Pat. No. 4,831,956 to Thater (1989) discloses a one sided tennis scoring apparatus constructed of a durable fabric and designed so as to be foldable about itself into a small portable configuration however the apparatus is specifically designed and limited for use in the sport of tennis and therefore fails to support a variety of sports and venues.

In addition, inventors have also created several approaches to solving the problem of organizing sports equipment, specifically in baseball and softball dugouts. U.S. Pat. No. 5,337,907 to McKenzie and Ingle (1994) discloses a predetermined location holder for beverage containers and related articles, U.S. Pat. No. 6,053,340 to Cameron (2000) discloses a back supported sports equipment rack, and U.S. Pat. No. 6,029,830 to Manookian (2000) discloses a length adjusting sports equipment hanging belt, all of which are specific in claims and fail to incorporate a scoring capability in their disclosures.

In conclusion, insofar as I am aware, no scoreboard or scoring apparatus formerly developed provides a team banner which also serves as a two-sided, self contained scoring device capable of supporting a large variety of sporting events and venues. In addition, insofar as I am aware, no scoreboard or scoring apparatus developed provides a multi-sport scoring device capable of also organizing sports equipment.

BACKGROUND OF THE INVENTION

Objects and Advantages

Team banners are growing in popularity. These banners are made of flexible durable material such as vinyl, canvas or nylon allowing it to be large but compactable. These banners can be easily rolled-upon-themselves into a lightweight cylinder and therefore easily carried and transported. The banner, compact and in a cylindrical form, provides easy storage in a coach's or player's equipment bag taking up no more room than a baseball bat or a rolled up catcher's chest protector. The banner supports customized visibility to all participants for any sporting event by being placed on fences, hung between posts, hung on walls or staked into the ground. It is the intention of this inventor to provide a two-sided scoring device that achieves all the benefits of a sports banner including its ability to be compact, portable, self-contained and adaptable to a large variety of sporting events and venues. Specifically, benefits of a sports banner include:

a) sufficiently large so that while in a spread out position a team's insignia is legibly visible to a person with normal vision who is positioned at least 30 feet away from the banner.

b) compact being made of flexible material so that entire banner can be repeatedly rolled-upon-itself without fracturing.

c) self-contained having all required components stored and transported within its compact rolled-upon-itself form.

d) capable of multi-venue setup being easily displayed in any sporting event venue, including any outdoor or indoor venue without special attachments beyond what is self-contained in the unit.

Accordingly, several objects and advantages of the present invention are:

(a) to provide a sports team banner to display team insignia's which has the dual purpose of a multi-sport scoring device.

(b) to provide an all-purpose scoring banner constructed of lightweight flexible material with means to be compacted, or rolled-upon-itself into a tight cylindrical form for easy storage and transportation.

(c) to provide a multi-sport portable scoring banner having display components required for any sporting event or venue self-contained for easy and compact storage and transfer.

(d) to provide a multi-sport, compact and portable scoring banner with the means to be quickly and easily setup and displayed in a variety of sporting venues.

(e) to provide a multi-sport scoring banner capable of being used by youth sports participants with limited adult supervision.

(f) to provide a multi-sport scoring banner with the means to display opposing team scores on both sides of the banner and visible to a person with normal vision positioned at least thirty feet away.

(g) to provide a multi-sport scoring banner capable of organizing sports equipment.

(h) to provide a multi-sport scoring banner capable of enhancing the entertainment value of the sporting event through sound devices and team mascot display.

(i) to provide a fundraising mechanism for youth sports through banner advertising.

Further objects and advantages are to provide a durable and reusable multi-sport scoring banner, resistant to weather elements and inexpensive to manufacture. Still further objects and advantages will become apparent from a consideration of the ensuing description and drawings.

SUMMARY

A two-sided scoring banner having two durable flexible faces, a plurality of secured flexible scoring elements and a simple means to hang, attach or anchor scoring banner for display in a variety of sporting venues. Scoring banner also having the means to organize and display a variety of sports related equipment.

DRAWINGS

DRAWINGS—REFERENCE NUMERALS

| | | | |
|---|---|---|---|
| 30 | Scoring banner | | |
| 32 | Front face | 34 | Back face |
| 36 | Top edge | 38 | Right edge |
| 40 | Bottom edge | 42 | Left edge |
| 44A | Home tens digit scoring disk | 44B | Home singles digit scoring disk |
| 44C | Visitor tens digit scoring disk | 44D | Visitor singles digit scoring disk |
| 46A | Home tens digit scoring symbol | 46B | Home singles digit scoring symbol |
| 46C | Visitor tens digit scoring symbol | 46D | Visitor singles digit scoring symbol |
| 48 | Home front window | 50 | Visitor front window |
| 52 | Home back window | 54 | Visitor back window |
| 56 | Binding screw post | 58 | Anchoring rod |
| 60 | First anchoring rod linear pocket | 62 | Second anchoring rod linear pocket |
| 64 | First anchoring rod storage pocket | 66 | Second anchoring rod storage pocket |
| 68 | Top stabilizing rod | 70 | Top stabilizing rod linear pocket |
| 72A | Bottom right eyelet through-hole | 72B | Top right eyelet through-hole |
| 72C | Top left eyelet through-hole | 72D | Bottom left eyelet through-hole |
| 74 | Team insignia | 76 | Home heading |
| 78 | Visitor heading | 80 | Home scoring scroll |
| 80A | Home top scroll knob | 80B | Home bottom scroll knob |
| 80C | Home two digit scoring symbol | 82 | Visitor scoring scroll |
| 82A | Visitor top scroll knob | 82B | Visitor bottom scroll knob |
| 82C | Visitor two digit scoring symbol | 84 | Transparent pocket |
| 86 | Pocket seal | 88 | Team roster transparent pocket |
| 90 | Utility storage pocket | 92 | Team mascot storage pocket |
| 94A | Ball scoring element | 94B | Inning scoring element |
| 94C | Strike scoring element | 96A | Visitor time out scoring element |
| 96B | Period scoring element | 96C | Home time out scoring element |
| 98A | Home team foul scoring element | 98B | Visitor team foul scoring element |
| 100 | Attachment device | 102 | Bungee cord |
| 104 | Volleyball net poles | 106 | Chain link fence |
| 108 | Flat surface | 110 | Equipment storage loops |
| 112 | Baseball/softball bat | 114 | Batting helmet |
| 116 | Baseball glove | 118 | Baseball hat |
| 120 | Hooks | 122 | Sports drink bottle |
| 124 | Batting Glove | 126 | Sound device pocket |
| 128 | Team toy mascot | 130 | Advertisement sign |
| 132 | Home tens digit scoring card | 134 | Home singles digit scoring card |
| 136 | Visitor tens digit scoring card | 138 | Visitor singles digit scoring card |
| 140 | Ring | 142 | Ring support rod |
| 144 | Support rod sleeve | 146 | Home scoring card window |
| 148 | Visitor scoring card window | | |

DETAILED DESCRIPTION—FIGS. 1–7

Preferred Embodiment

Figure 1:
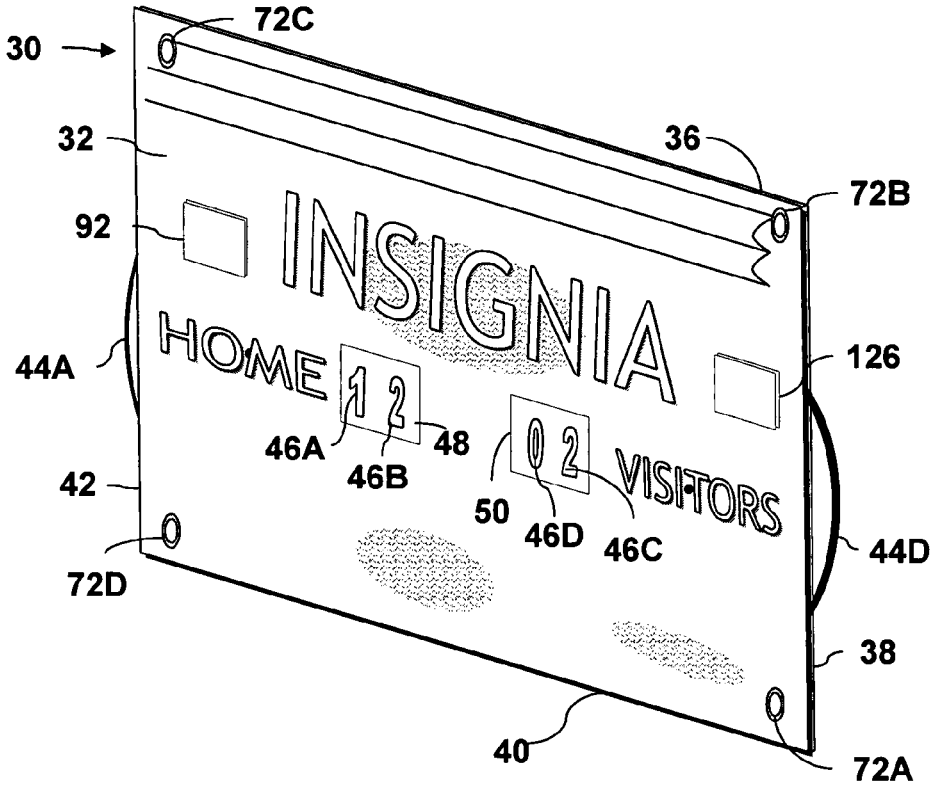
FIG. 1 is a perspective front view of the multi-sport, two-sided scoring banner constructed in accordance with the invention using a plurality of flexible rotating disks for scoring elements.
Figure 2:
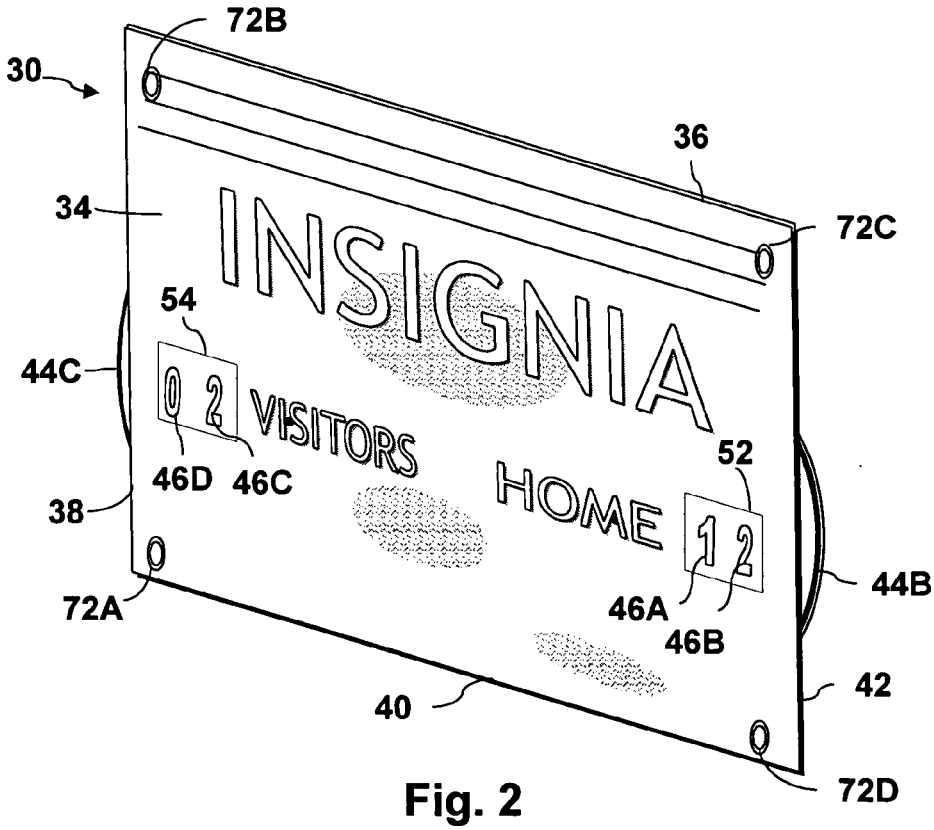
FIG. 2 is a perspective back view of the multi-sport, two-sided scoring banner constructed in accordance with the invention using a plurality of flexible rotating disks for scoring elements.
Figure 3:
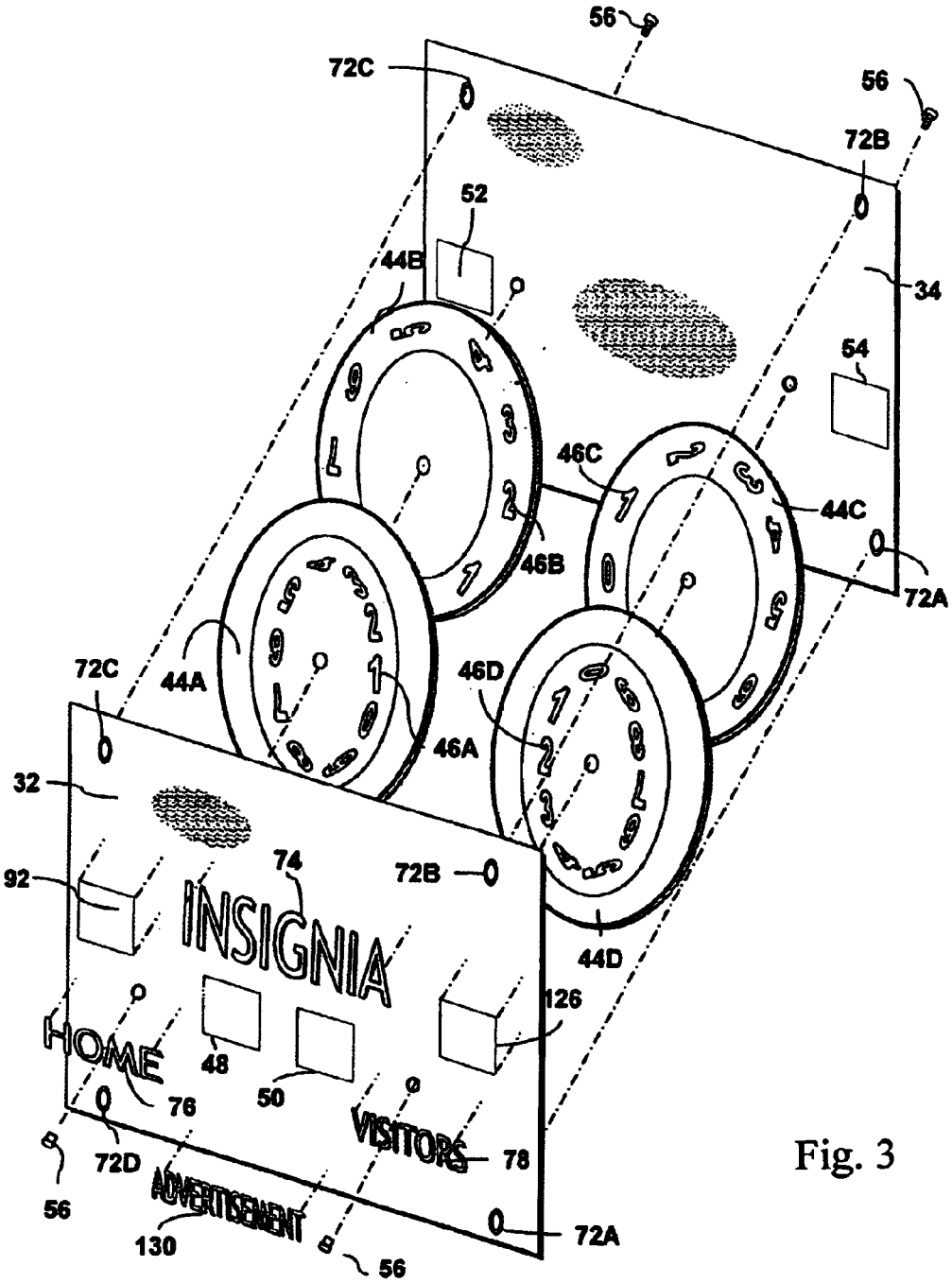
FIG. 3 is an exploded front view of the multi-sport, two-sided scoring banner constructed in accordance with the invention using a plurality of flexible rotating disks for scoring elements.

FIG. 1 is a perspective front view of a scoring banner 30, constructed in accordance with the invention. FIG. 2 is a perspective back view of banner 30 and FIG. 3 is a front perspective exploded view of banner 30. A front face 32 (FIG. 1, FIG. 3) and a back face 34 (FIG. 2, FIG. 3) made of a flexible piece of material which can be repeated rolled and unrolled without fracturing or becoming misshapen. In the preferred embodiment, front face 32 and back face 34 are made of flexible pieces of fabric such as polyester, duck canvas, nylon, rayon, vinyl or various other impregnated or laminated fibrous materials. Back face 34 and front face 32 may be sewn, glued, riveted or thermally bonded along strategically selected areas including but not limited to a top edge 36, a right edge 38, a bottom edge 40 and a left edge 42 to form the body of scoring banner 30.

A home front window 48 (FIG. 1, FIG. 3) and a visitor front window 50 (FIG. 1, FIG. 3) formed into front face 32 and a home back window 52 (FIG. 2, FIG. 3) and a visitor back window 54 (FIG. 2, FIG. 3) formed into the back face 34. A home tens digit scoring disk 44A (FIG. 1, FIG. 3) and a home singles digit scoring disk 44B (FIG. 2, FIG. 3) aligned on top of one another, secured and sandwiched between front face 32 and back face 34. A visitor tens digit scoring disk 44C (FIG. 2, FIG. 3) and a visitor singles digit scoring disk 44D (FIG. 1, FIG. 3) aligned on top of one another, secured and sandwiched between front face 32 and back face 34.

Referring to FIG. 3 scoring element disks 44A, 44B, 44C, 44D made of a flexible piece of material and formed into a disk which can be repeatedly rolled and unrolled without fracturing or becoming misshapen. In the preferred embodiment scoring elements 44A, 44B, 44C, 44D made of a plastic material comprised for example of extruded amorphous polypropylene co-polymer available from NAP, Inc. of Tallahassee, Fla. Each scoring element 44A, 44B, 44C, 44D axially mounted through holes in their respective centers and sandwiched and secured between front face 32 and back face 34 using a binding screw post 56. Post 56 of sufficient length to allow scoring elements 44A, 44B, 44C, 44D to be held loosely in place, free to rotate along its axis with a minimum amount of tangential force applied to the exposed part of disk 44A, 44B, 44C, 44D circumference. Slight friction between the inside back of front face 32 and inside front of back face 34 prevent scoring elements 44A, 44B, 44C, 44D from freely rotating. Other means of mounting the scoring elements may be used including axial or circumferential mounting using rivets, eyelets, bolts and screws.

Continuing to referring to FIG. 1, FIG. 2 and FIG. 3, a home team's single scoring symbol 46B including the numeric digits 0, 1, 2, 3, 4, 5, 6, 7, 8, 9 placed on the front and back face of the interior radial portion of home team's singles scoring element 44B (FIG. 3), the back digits phased 180 degrees from the front digits. The interior radial portion of scoring element 44B being transparent matching the interior portion of home team's tens digit scoring element 44A (FIG. 3). A home team's tens scoring symbol 46A including the numeric digits 0, 1, 2, 3, 4, 5, 6, 7, 8, 9 placed on the front and back of the interior radial portion of scoring element 44A (FIG. 3), the back digits phased 180 degrees from the front digits. Front window 48 (FIG. 1, FIG. 3) and back window 52 (FIG. 2, FIG. 3) strategically placed to match the display of scoring symbols 46A, 46B. Teams may maintain and display the home team score of a sporting event by means of rotating the scoring element 44A (FIG. 1, FIG. 3) along its axis to place the tens scoring symbol 46A in both front window 48 (FIG. 1, FIG. 3) and back window 52 (FIG. 2, FIG. 3) and rotating scoring element 44B (FIG. 2, FIG. 3) along its axis to place singles scoring symbol 46B in front window 48 (FIG. 1, FIG. 3) and back window 52 (FIG. 2, FIG. 3).

Continuing to refer to FIG. 1, FIG. 2 and FIG. 3, a visitor team's singles scoring symbol 46D including the numeric digits 0, 1, 2, 3, 4, 5, 6, 7, 8, 9 placed on the front and back face of the interior radial portion of visitor team's singles scoring element 44D (FIG. 3), the back digits phased 180 degrees from the front digits. The exterior radial portion of scoring element 44D (FIG. 3) being transparent matching the exterior portion of visitor team's tens digit scoring element 44C (FIG. 3). A visitor team's tens scoring symbol 46C including the numeric digits 0, 1, 2, 3, 4, 5, 6, 7, 8, 9 placed on the front and back of the exterior radial portion of scoring element 44C (FIG. 3), the back digits phased 180 degrees from the front digits. Front window 50 (FIG. 1, FIG. 3) and back window 54 (FIG. 2, FIG. 3) strategically placed to match the display of scoring symbols 46C, 46D. Teams may maintain and display the visitor team's score of a sporting event by means of rotating the scoring element 44D (FIG. 2, FIG. 3) along its axis to place the singles scoring symbol 46D in both front window 50 (FIG. 1, FIG. 3) and back window 54 (FIG. 2, FIG. 3) and rotating scoring element 44C (FIG. 1, FIG. 3) along its axis to place the tens scoring symbol 46C in front window 50 (FIG. 1, FIG. 3) and back window 54 (FIG. 2, FIG. 3).

In the preferred embodiment a team mascot storage pocket 92 (FIG. 1, FIG. 3) is attached to the front face of banner 30 providing means to hold and display a team toy mascot 128 (FIG. 25). Pocket 92 made of a flexible piece of material which can be repeated rolled and unrolled without fracturing or becoming misshapen. In the preferred embodiment, pocket 92 is made of flexible pieces of fabric such as polyester, duck canvas, nylon, rayon, vinyl or various other impregnated or laminated fibrous materials. Pocket 92 may be attached to the front face by means of sewing, glue, rivets, thermal bonding or other common means of bonding.

In the preferred embodiment a sound device pocket 126 (FIG. 1, FIG. 3) is attached to the front face of banner 30 providing means to hold a conventional self-powered sound device or sound device and receiver (not shown). Pocket 126 made of a flexible piece of material which can be repeated rolled and unrolled without fracturing or becoming misshapen. In the preferred embodiment, pocket 126 made of flexible pieces of fabric such as polyester, duck canvas, nylon, rayon, vinyl or various other impregnated or laminated fibrous materials. Pocket 126 may be attached to the front face by means of sewing, glue, thermally bonding, riveting or other common means of bonding.

Continuing to refer to FIG. 3, a team insignia 74, a home heading 76, a visitor heading 78, an advertisement sign 130 or other customized signs may be attached to the front face 32 and the back face 34. Team insignia 74, heading 76, 78, advertisement sign 130 may be printed onto face 32, 34 by means of silk screen printing, paint, ink or any other common means of printing. Team insignia's 74, heading 76, 78 and advertising sign 130 may also be made of separate printed pieces of flexible material and attached to face 32, 34 by means of gluing, heat transfer, thermal bonding, Velcro, rivets, pins or other common means of bonding.

Figure 4:
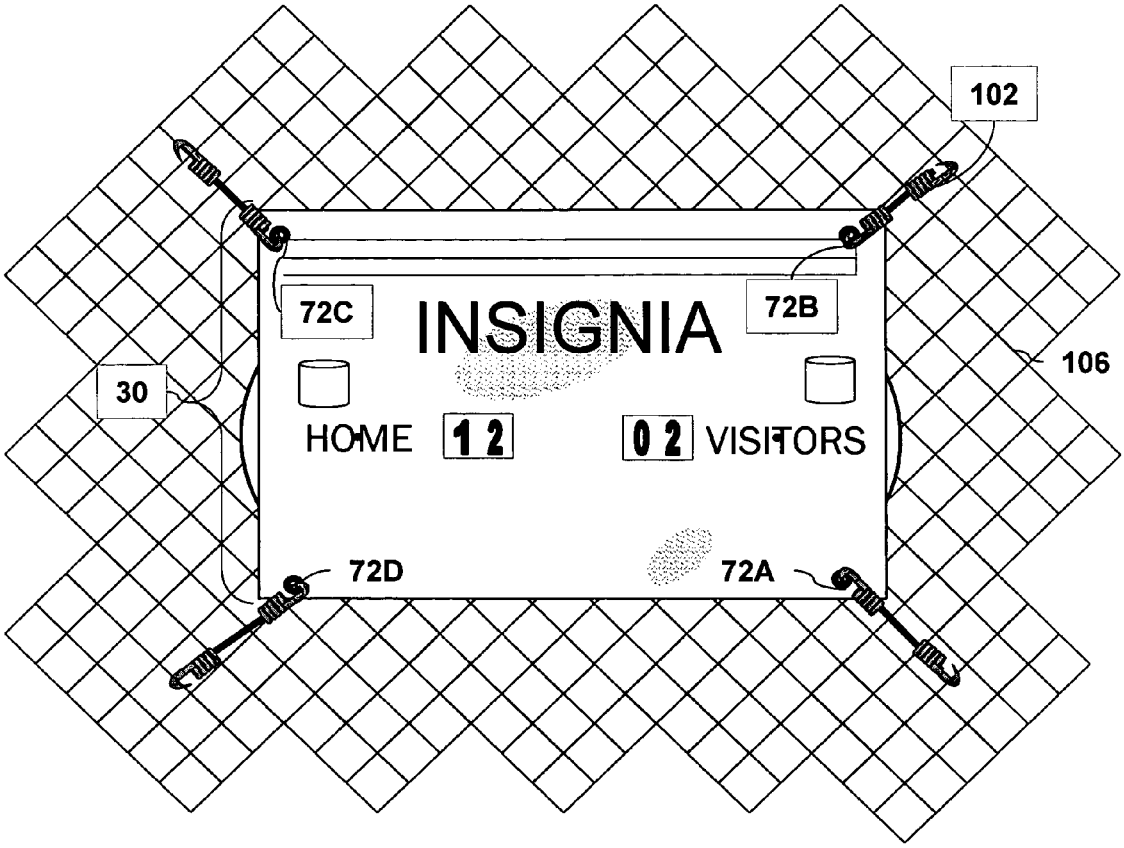
FIG. 4 is a front view of the preferred embodiment of the present invention attached to a chain link fence.

Referring to FIG. 4 (front view), scoring banner 30 is presented in its utility configuration spread out and attached to a chain link fence 106 using a plurality of bungee cords 102 hooked through a plurality of through-hole eyelets 72A, 72B, 72C, 72D. Eyelets 72A, 72B, 72C, 72D strategically placed into and through front face 32 and back face 34 providing further bonding of faces 32, 34. In the preferred embodiment eyelets 72A, 72B, 72C, 72D made of brass however may also consist of any common material used in commercially available eyelets.

Figure 5:
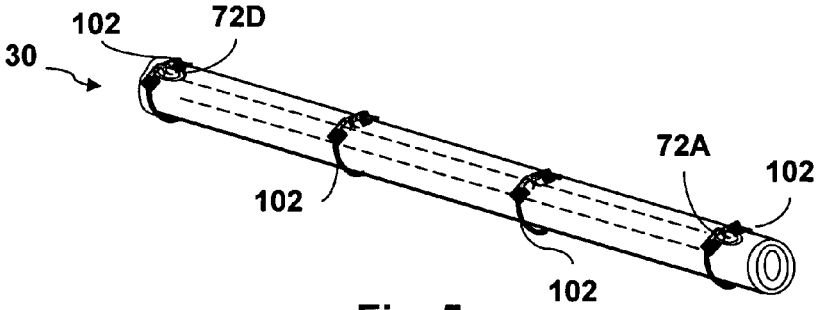
FIG. 5 is a perspective front view of the preferred embodiment of the present invention in its rolled up configuration.
Figure 6:
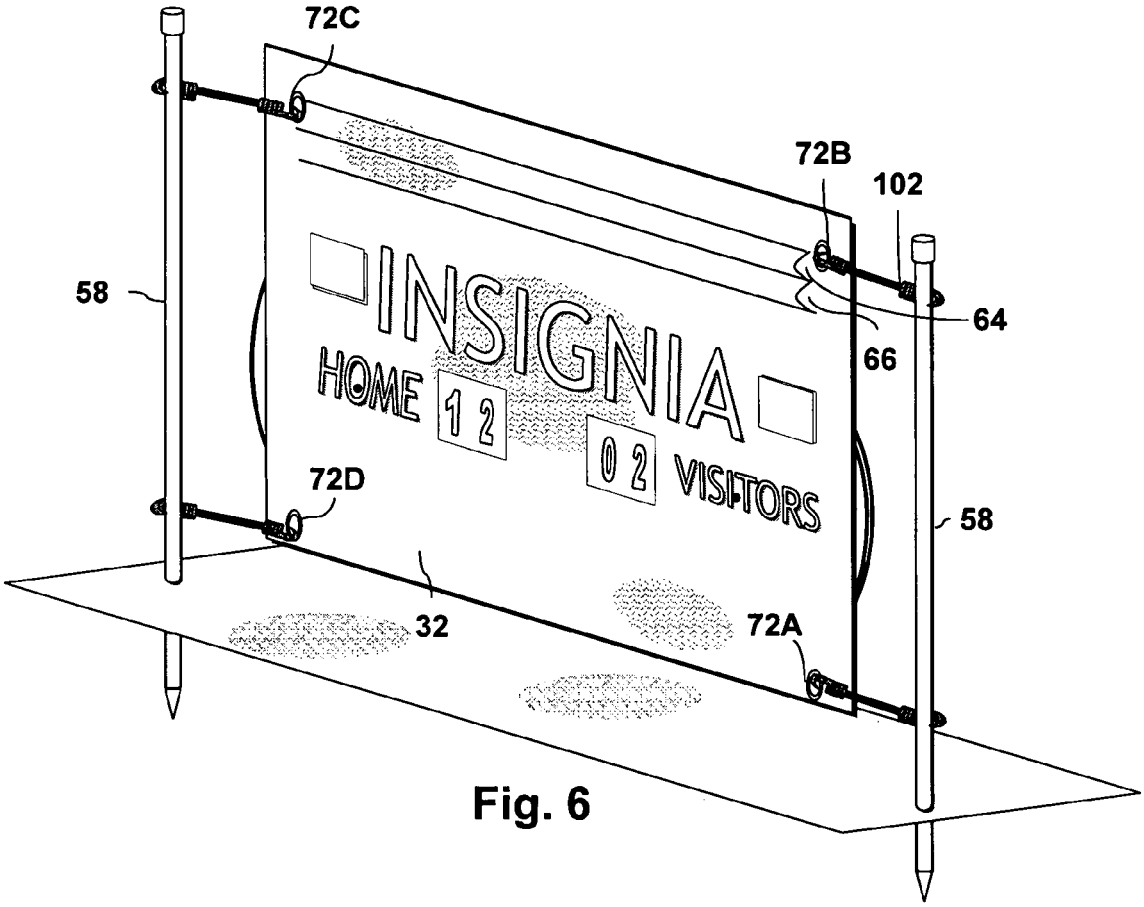
FIG. 6 is a front perspective view of the preferred embodiment displayed between two ground anchoring rods.

Referring to FIG. 5 (perspective front view), scoring banner 30 is presented in its rolled up, compact and transportable configuration and secured using bungee cords 102. FIG. 6 provides a perspective front view of an alternative ground display embodiment of scoring banner 30. A plurality of anchoring rods 58 secure banner 30 into the ground for display using bungee cords 102 attached to eyelets 72A, 72B, 72C, 72D.

Figure 7:
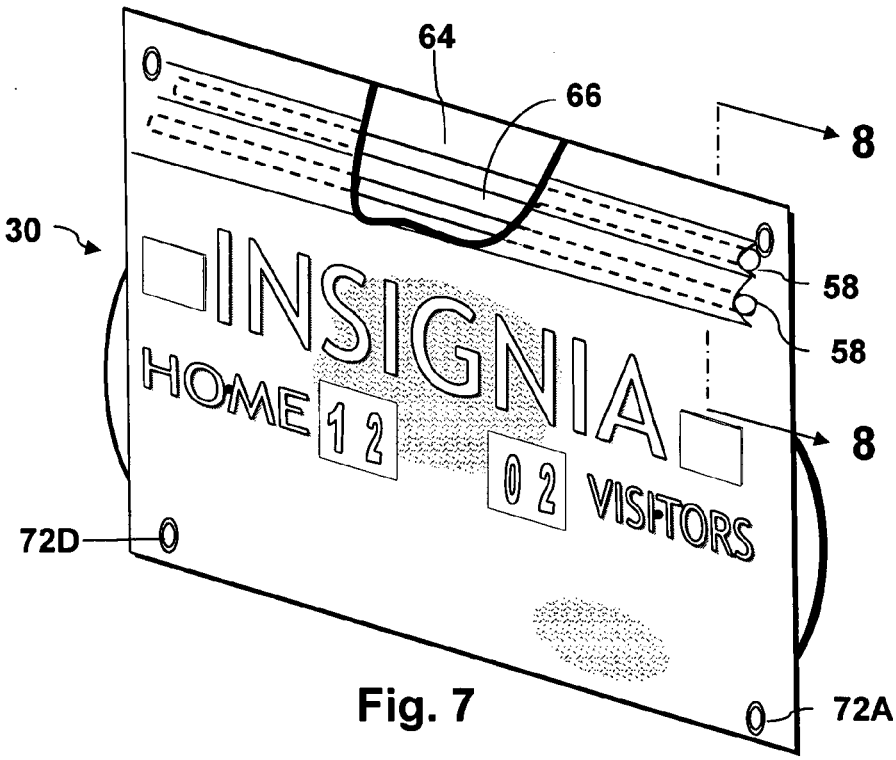
FIG. 7 is a perspective front view of the preferred embodiment of the present invention showing a cutout view of the ground anchoring rods inserted into their respective storage pockets in preparation for transport and storage.
Figure 8:
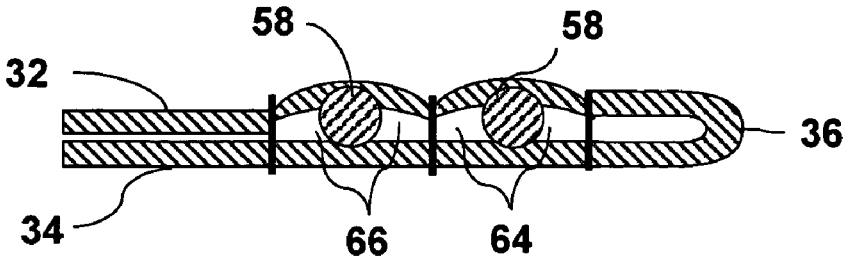
FIG. 8 is a right side cross-sectional view of the preferred embodiment of the present invention showing the anchoring rods in their respective storage pockets in preparation for transport and storage.
Figure 9:
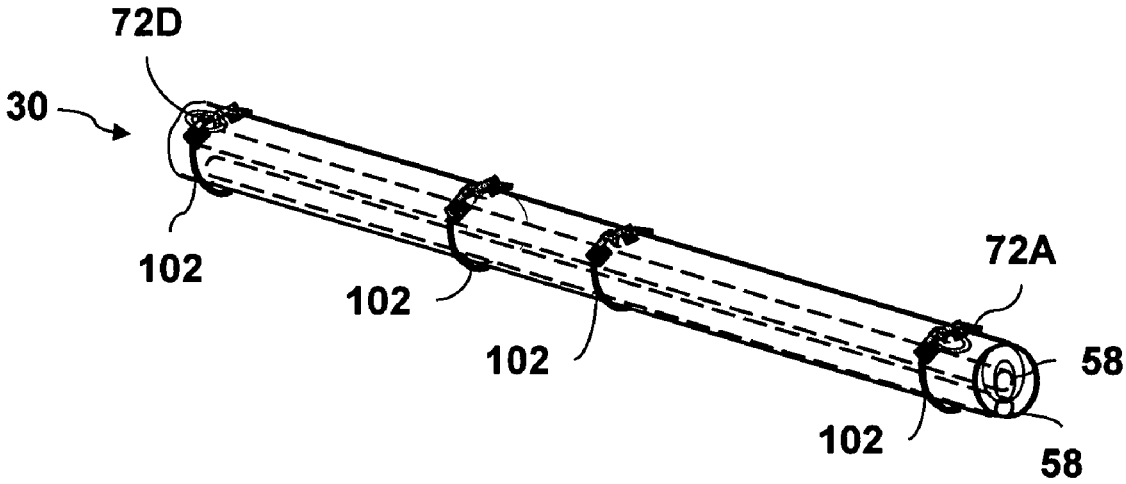
FIG. 9 is a perspective view of the preferred embodiment of the present invention showing the anchoring rods and scoring elements in a rolled up configuration within the scoring banner and held together by bungee cords ready for transportation and storage.

FIG. 7 is a perspective front view of the same alternative ground display embodiment of banner 30 shown in FIG. 6. Anchoring rods 58 are shown stored in a first anchoring rod storage pocket 64 and a second anchoring rod storage pocket 66 and exposed through a cutout view of a portion of front face 32. FIG. 8 provides a right side cross sectional cutout view of the ground display for scoring banner 30. Anchoring rods 58 are contained within their respective storage pockets 64, 66. FIG. 9 is a perspective front view of the ground display scoring banner 30 rolled up into a tight cylindrical configuration ready for storage and transportation. Anchoring rods 58 are rolled up within scoring banner 30 and secured by bungee cords 102.

Figure 10:
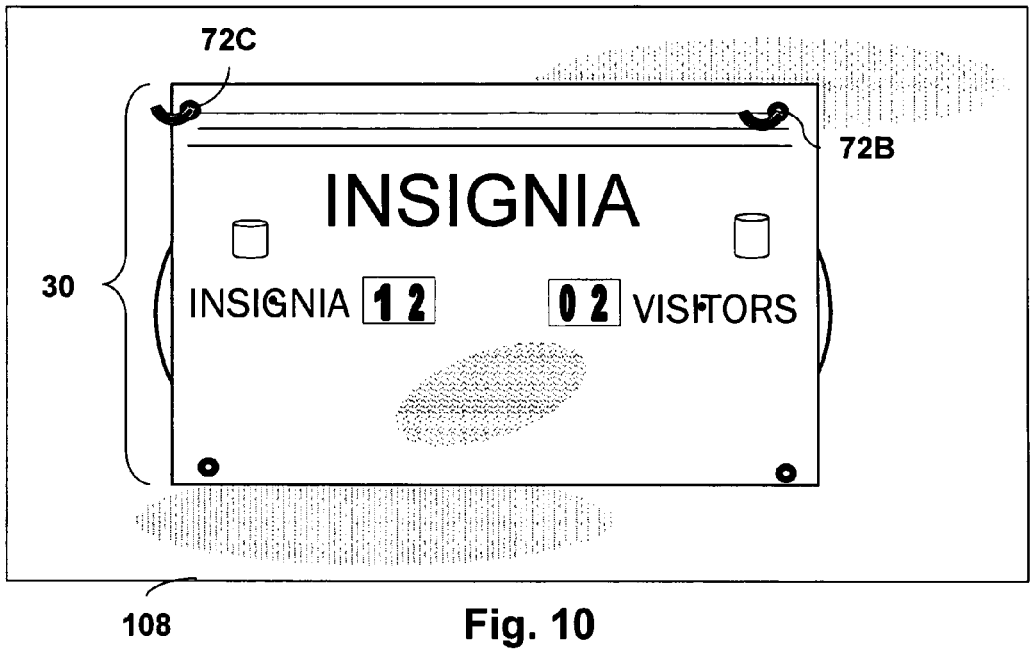
FIG. 10 is a front view of the preferred embodiment of the present invention being hung on a flat surface.

FIG. 10 provides a flat surface display embodiment of banner 30. Scoring banner 30 capable of being hung on any flat surface containing hooks or pins through eyelets 72C, 72B or other common means of attachment such as tape, or Velcro.

Figure 11:
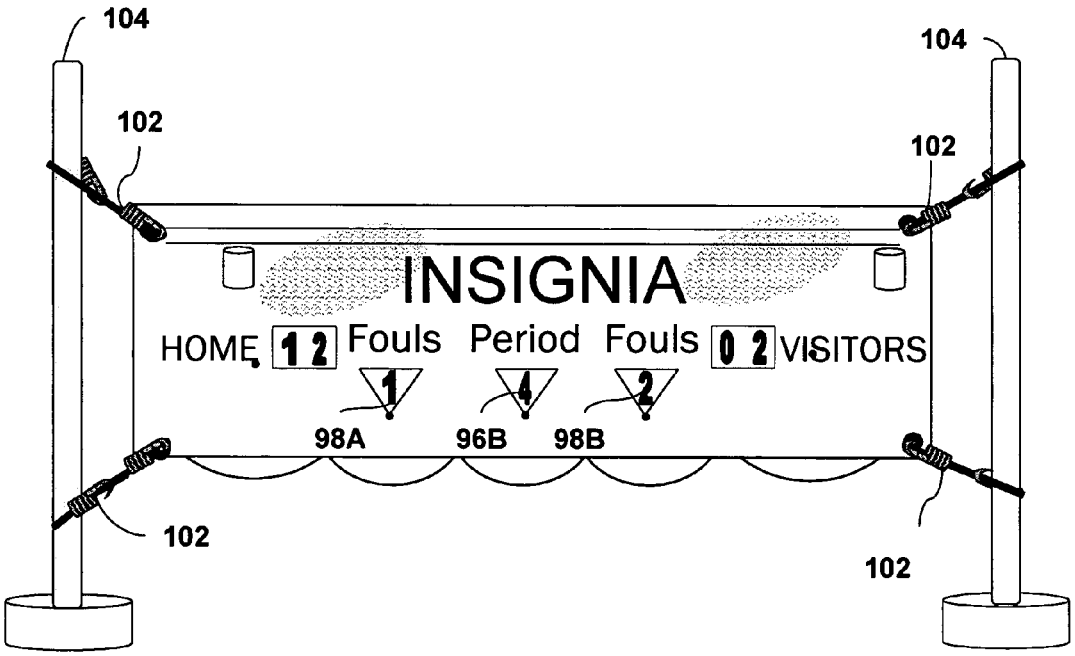
FIG. 11 is a front side view of larger embodiment of the present invention hung between two volleyball posts with additional scoring elements for the game of basketball.

FIG. 11 provides a larger version of the present invention attached between a plurality of volleyball net poles 104. This embodiment includes additional scoring elements added for basketball including a home team fouls scoring element 98A, a period scoring element 96B and a visitor team fouls scoring element 98B.

Figure 12:
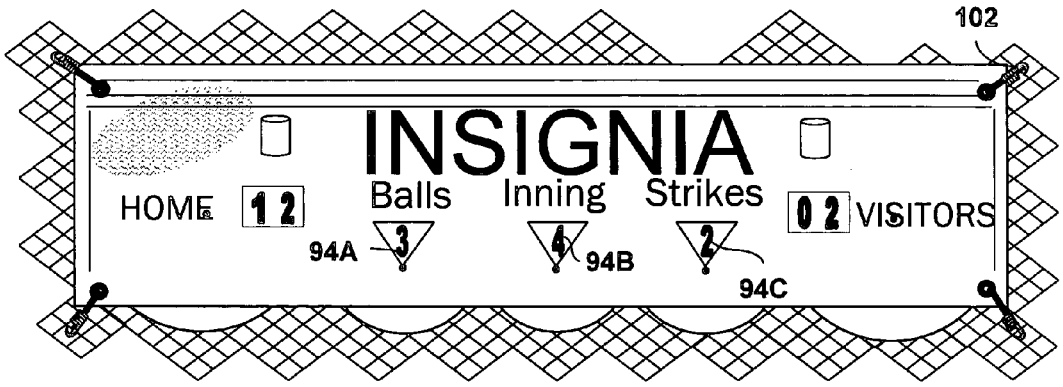
FIG. 12 is the front side view of a larger embodiment of the present invention hung on a backstop and with additional scoring elements for the game of baseball or softball.

FIG. 12 presents a larger version of the present invention with additional scoring elements added for baseball including, a ball scoring element 94A, an inning scoring element 94B, and a strikes scoring element 94C.

Figure 13:
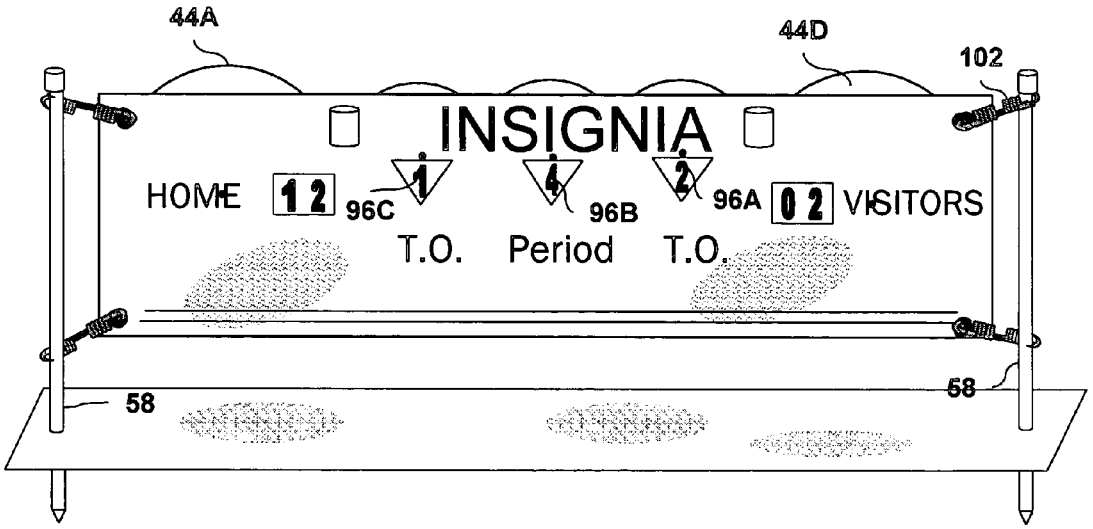
FIG. 13 is a front side view of a larger embodiment of the present invention hung between two anchoring rods with additional scoring elements for the game of football or soccer.
Figure 20:
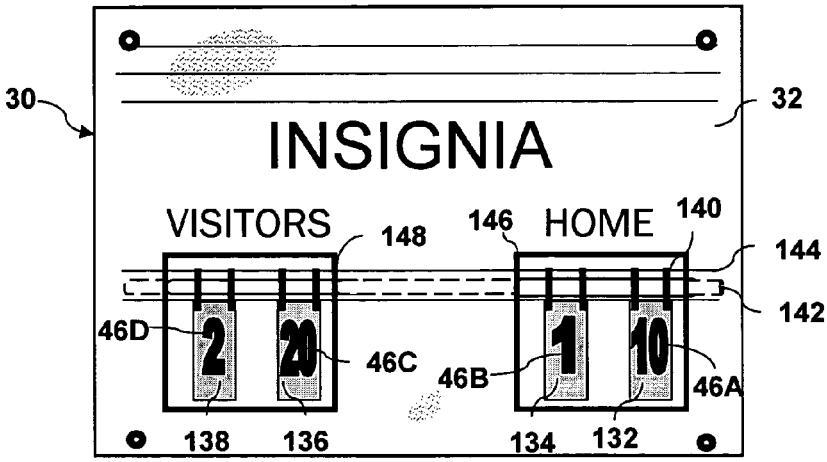
FIG. 20 is a front view of an alternative scoring embodiment of the present invention using flip cards as scoring elements.

FIG. 13 presents a larger version of the present invention with additional scoring elements added for football, rugby or soccer including, a visitor time out scoring element 96A, a period scoring element 96B, and a home time out scoring element 96C. FIG. 20 also provides an example of alternative placement locations of scoring elements disks 44A, 44D on scoring banner 30.

Figure 14:
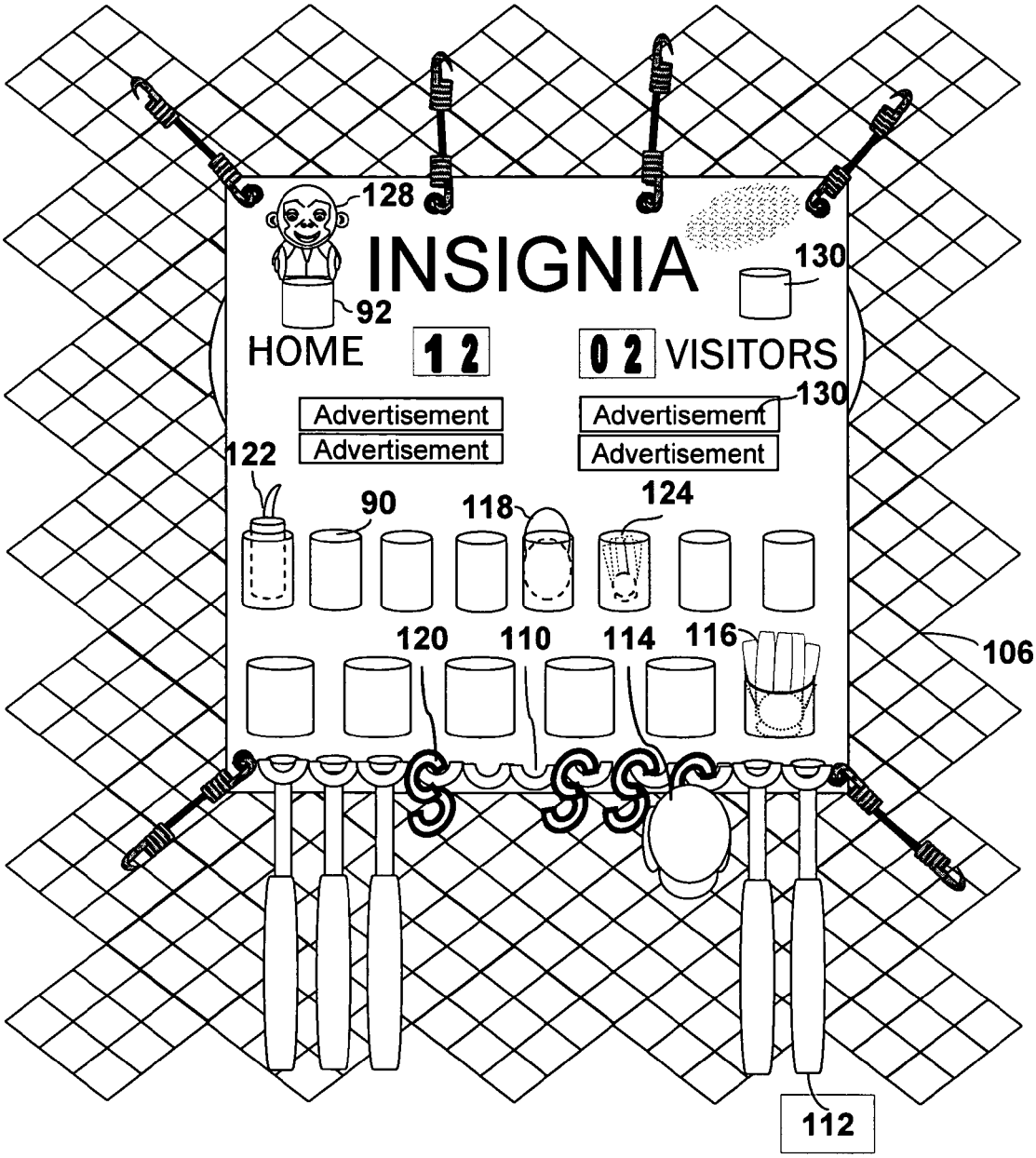
FIG. 14 is a front side view of a larger embodiment of the present invention incorporating equipment storage pockets, equipment storage loops, and hooks to organize sports equipment including a team mascot toy.
Figure 15:
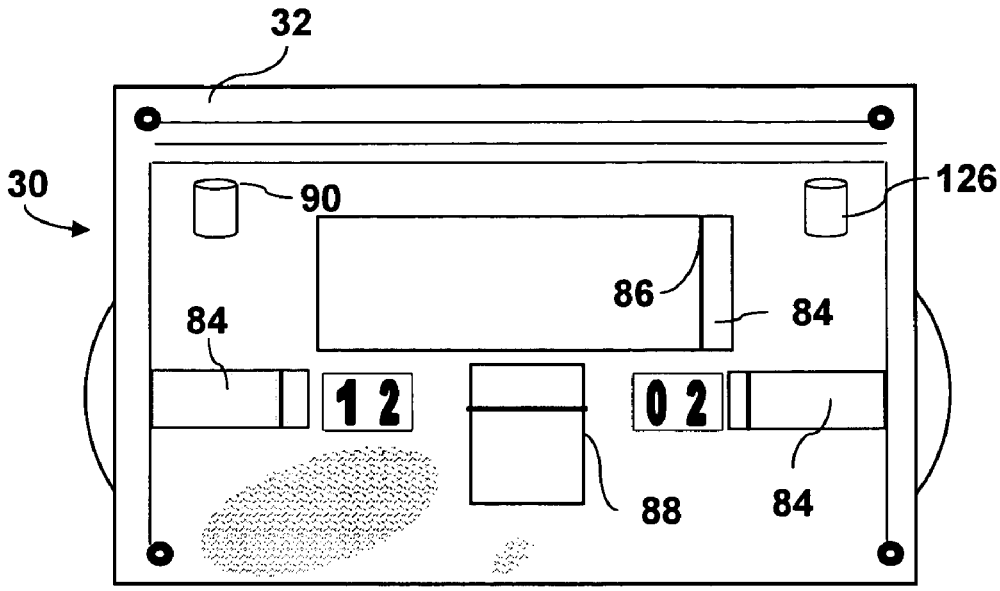
FIG. 15 is a front side view of a specific embodiment of the present invention incorporating transparent slide pockets for display and protection of pre-printed team insignia inserts, scoring element titles and team rosters.

FIG. 14 provides a front view of a specific embodiment of scoring banner 30 including a plurality of utility storage pockets 90 attached to front face 32. Storage pockets 90 made of a flexible piece of material which can be repeated rolled and unrolled without fracturing or becoming misshapen. In the preferred embodiment, storage pockets 90 made of flexible pieces of fabric such as duck canvas, nylon, rayon, vinyl or polyester, or various other impregnated, laminated or meshed fibrous materials. Storage pockets 90 attached to front face 32 by means of sewing, gluing, thermal bonding or other commons means of bonding two materials. Sports items such as a plurality of baseball batting gloves 124, a plurality of baseball hats 118, or a plurality of sport drink bottles 122 can be placed in storage pockets 90 for organization and storage. A plurality of baseball/softball bats 112 can be organized and displayed by means of slipping and hanging bat 112 through a plurality of equipment storage loops 110. Loops 110 attached to front face 32 by means of sewing, gluing, thermal bonding or other commons means of bonding materials. Loops 110 made of flexible material such as duck canvas, nylon, rayon, vinyl, polyester, rubber or any other flexible or elastic material. A plurality of hooks 120 may be attached to loops 110 providing a means to hang various sporting equipment items including for example but not limited to a plurality of batting helmets 114, baseball hats 118 and a plurality of baseball gloves 116. Team mascot toy 128 is shown in team mascot storage pocket 92.

Figure 16:
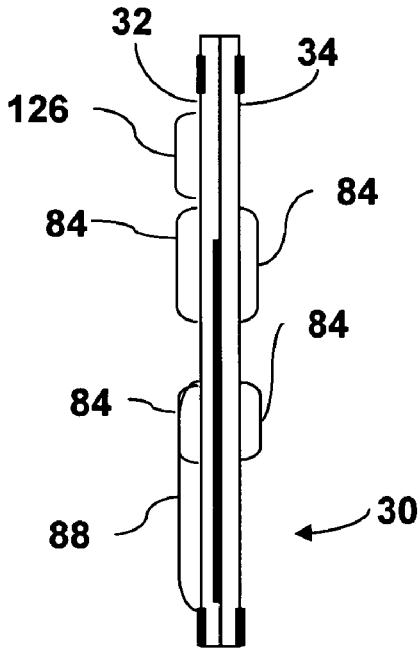
FIG. 16 is a right side view of a specific embodiment of the present invention incorporating transparent slide pockets for protection and display of pre-printed team insignia inserts, scoring element titles and team rosters
Figure 17:
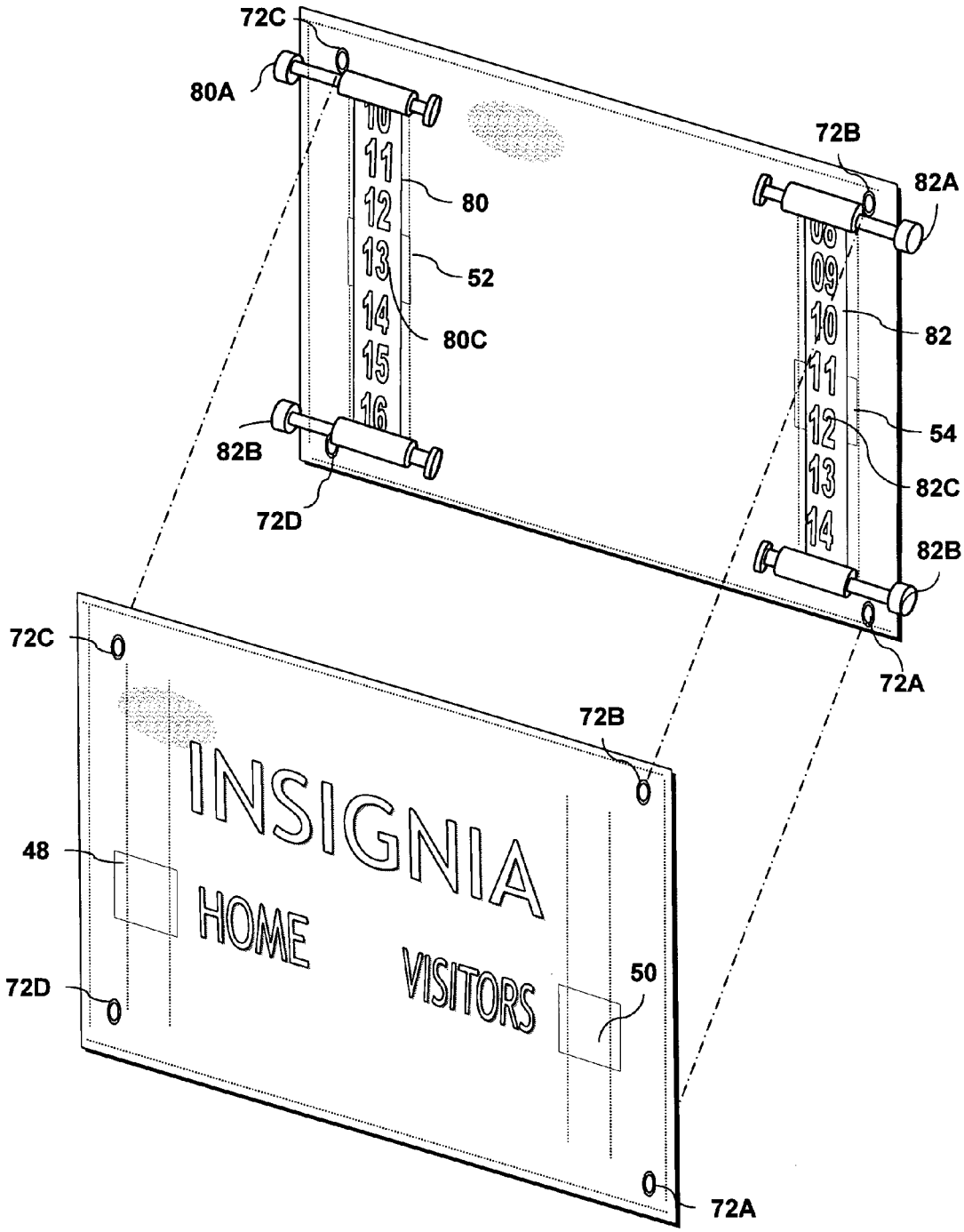
FIG. 17 is an exploded front view of an alternative scoring embodiment of the present invention using scrolls for scoring elements.

FIG. 16 is a front view and FIG. 17 is a side view of an alternative display embodiment of scoring banner 30. A plurality of transparent pockets 84 is shown attached to the front face 32 (FIG. 16) and back face 34 (FIG. 17). A team roster transparent pocket 88 is shown attached to front face 32. Pockets 84, 88 attached to front face 32 and back face 34 by means of sewing, glue, heat, rivets or other commonly available bonding practices. A variety of pre-printed materials may be displayed on front face 32 and back face 34 by sliding them into pockets 84. These pre-printed materials may be further protected from the elements by sealing the pocket with a pocket seal 86. Pockets, 84, 88, made of flexible pieces of transparent material such as polyethylene which can be repeated rolled and unrolled without fracturing or becoming misshapen.

Figure 18:
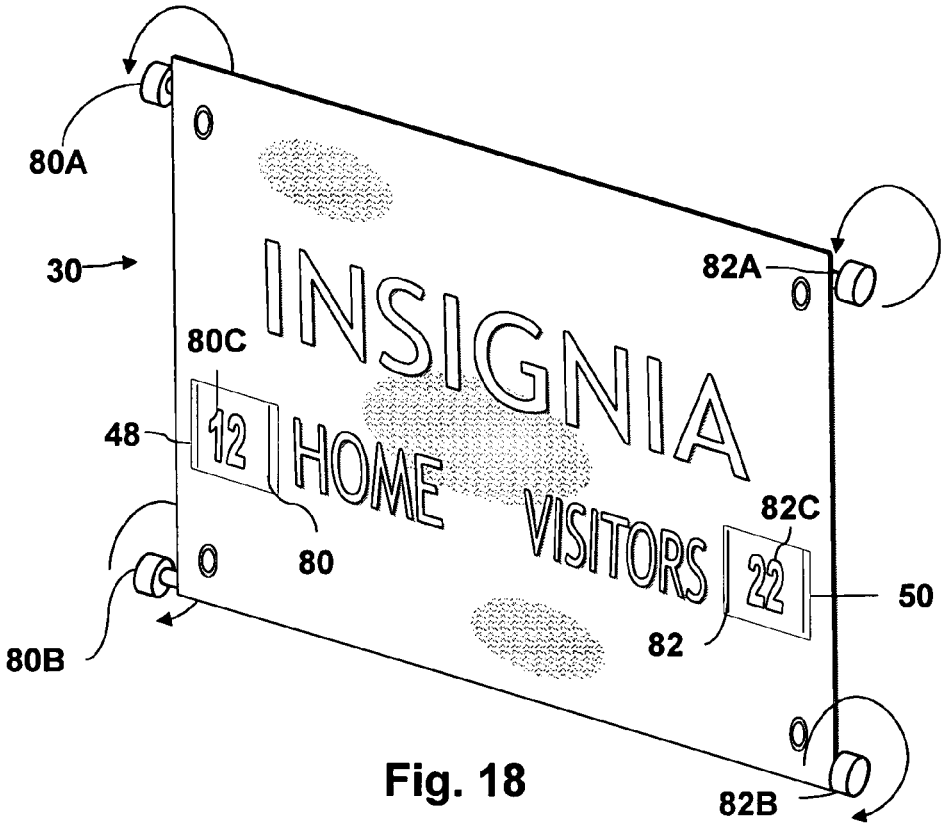
FIG. 18 is a perspective front view of an alternative scoring embodiment of the present invention using scrolls as scoring elements.
Figure 19:
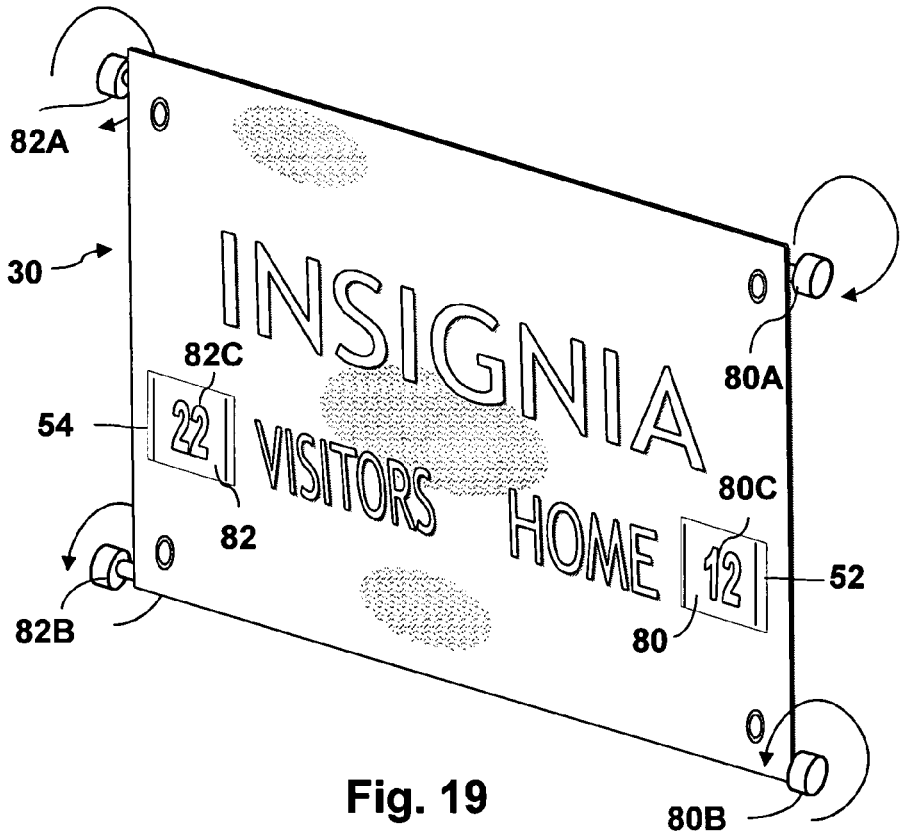
FIG. 19 is a perspective back view of an alternative scoring embodiment of the present invention using scrolls for scoring elements.

FIG. 18 is a front perspective view, FIG. 19 is a back perspective view and FIG. 20 provides an exploded view of an alternative scoring element embodiment of the present invention. Referring to FIG. 18 a home scoring scroll element 80 and a visitor scoring scroll element 82 sandwiched and secured between front face 32 and back face 34. Scrolls 80, 82 made of a flexible piece of material which can be repeated rolled and unrolled without fracturing or becoming misshapen. A plurality of home two digit scoring symbols 80C including the numeric digits 0 through 99 placed on the front and back face of scroll 80. A plurality of visitor two digit scoring symbols 82C including the numeric digits 0 through 99 placed on the front and back face of scroll 82. Referring to FIG. 19 and FIG. 20, teams may maintain and display the home team's score of a sporting event by indexing scroll 80 by rotating a home top scroll knob 80A counter-clockwise or a home bottom scroll knob 80B clockwise thus selectively displaying scoring symbol 80C in home front window 48 and home back window 52. Teams may maintain and display the visitor's score of a sporting event by indexing scroll 82 by rotating a visitor top scroll knob 82A counter-clockwise or a visitor bottom scroll knob 82B clockwise thus selectively displaying scoring symbol 82C in both visitor front window 50 and visitor back window 52.

Figure 21:
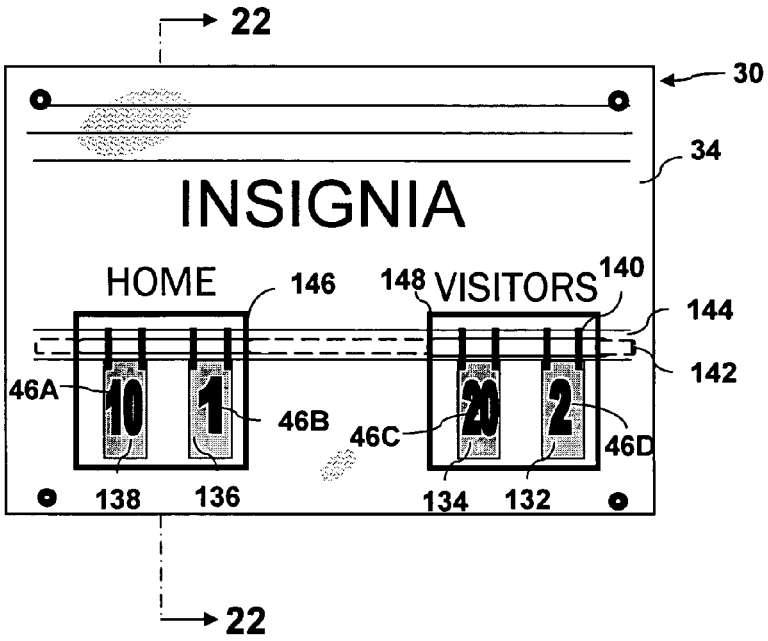
FIG. 21 is a back view of an alternative scoring embodiment of the present invention using flip cards for scoring elements.
Figure 22:
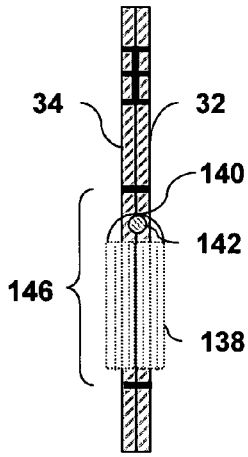
FIG. 22 is a right-side cross-sectional view of an alternative scoring embodiment of the present invention using flip cards for scoring elements.

FIG. 20 is a front view and FIG. 21 is a back view of an alternative scoring element embodiment of the present invention. FIG. 22 is a side cross-sectional view of the same embodiment. A home tens digit scoring card 132, a home singles digit scoring card 134, a visitor tens digit scoring card 136, and a visitor single digit card 138 used to display opposing team scores. Scoring cards 132, 134, 136, 138 made of a flexible piece of material which can be repeatedly rolled and unrolled without fracturing or becoming misshapen. Scoring cards 132, 134, 136, 138 having at least one consistently aligned hole formed at the top of each. A card holder ring 140 looped through each hole aligning the scoring cards 132, 134, 136, 138 into a plurality of paired stacks. A support rod sleeve 144 formed by creating a linear space between front face 32 and back face 34. Rod sleeve 144 formed by means of sewing, glue, rivets, thermal bonding or other common bonding techniques. A home scoring card window 146, and a visitor scoring card window 148 formed in the body of scoring banner 30 providing a means to hang and display scoring cards 132, 134, 136, 138 on a ring support rod 142. Referring to FIG. 20, ring support rod 142 slipped and secured to main scoring banner 30 through the left part of rod sleeve 144. Support rod 142 exposed through window 148, slipped through the center of the ring 140 of scoring element cards 138, 136. Card rod 142 slipped into the center of rod sleeve 144 and exposed through window 146 and slipped through the center of the ring 140 of scoring cards 134, 132. The end of support rod 142 finally secured through the right end of rod sleeve 144.

Once again referring to FIG. 20 and FIG. 21, visitor singles digit scoring symbol 46D including the digits 0, 1, 2, 3, 4, 5, 6, 7, 8, 9 displayed on the front face of each of scoring cards 138. A copy of scoring symbols 46D placed on the back face of the next in sequence scoring card 138 so that the same scoring symbol 46D is viewed on both the front face 32 and back face 34. This repeated for home singles scoring card 134 and home singles scoring symbol 46B. Visitor tens digit scoring symbol 46C including blank and the digits 10, 20, 30, 40, 50, 60, 70, 80, 90 displayed on the front face of each of visitor tens digit scoring card 136. A copy of scoring symbols 46C placed on the back face of the next in sequence scoring card 136 so that the same scoring symbol 46C is viewed on both the front face 32 and back face 34. Scoring is accomplished by flipping over and indexing singles digit scoring cards 138, 134 from zero to nine in increments of one and flipping over and indexing tens digit scoring cards 136, 132 from blank to ninety in increments of ten. Scores would be read by adding the tens digit scoring symbol value 46C, 46A to the singles digit scoring symbol value 46D, 46B for example, referring to FIG. 20:

| Front View | | | |
|---|---|---|---|
| Visitor | | Home | |
| Left Card | Right Card | Left Card | Right Card |
| 2 | 20 | 1 | 10 |

Score would be read twenty-two to eleven.

| Back View | | | |
|---|---|---|---|
| Home | | Visitor | |
| Left Card | Right Card | Left Card | Right Card |
| 10 | 1 | 20 | 2 |

Score would be read eleven to twenty-two.

Figure 23:
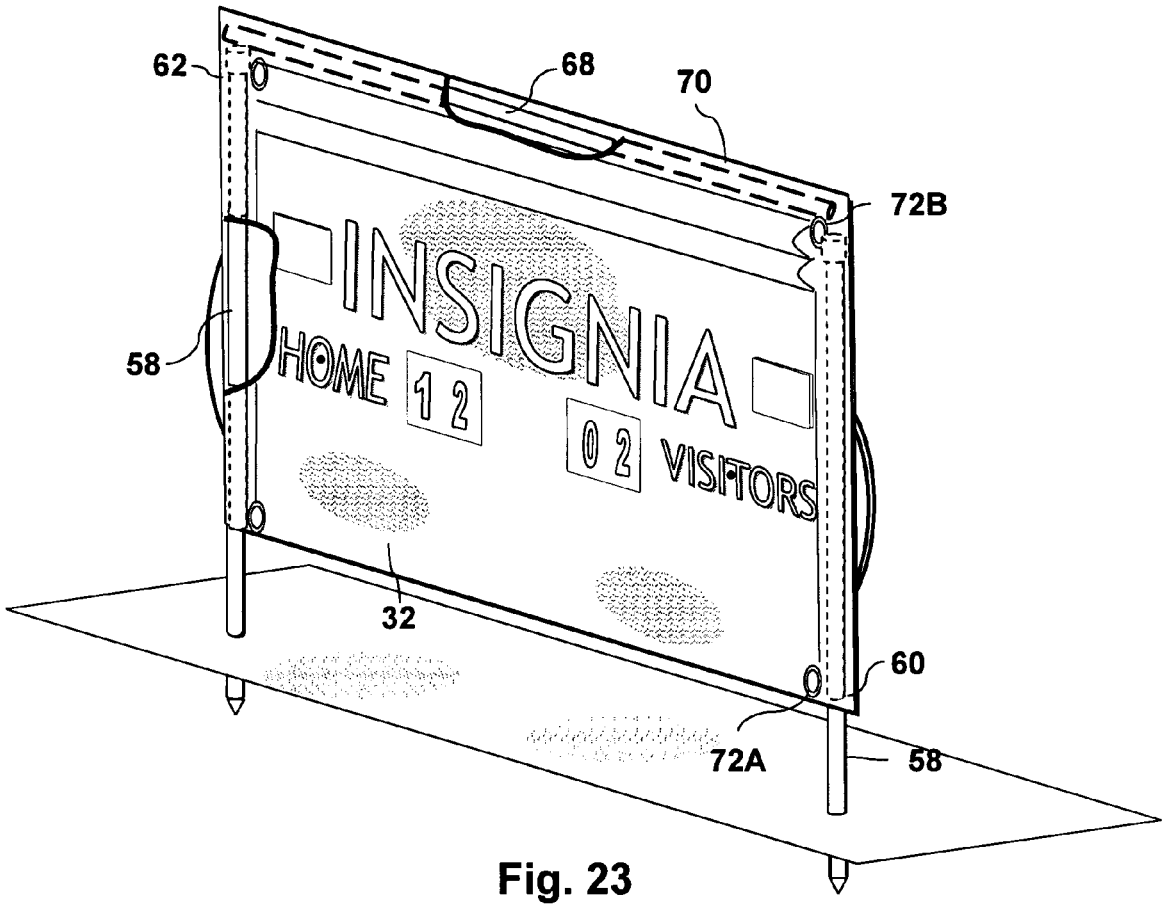
FIG. 23 is a perspective front view of a specific display embodiment of the present invention showing cutout views of the top anchoring rod shown inserted into its linear pocket and the right stabilizing rod and left anchoring rod inserted in their respective linear pockets.

FIG. 23 provides a perspective front view of scoring banner 30. A top stabilizing rod 68 is shown through a cutout view of a top stabilizing rod linear pocket 70. Anchoring rods 58 exposed through a cutout view of a first anchoring rod linear pocket 60 and a second anchoring rod linear pocket 62. According to a specific embodiment of the invention top rod 68 is slipped into a linear pocket 70 formed between the top of front face 32 and the top of back face 34. Anchoring rods 58 shown slipped into linear pockets 60, 62 respectively providing the means to anchor banner 30 into the ground. Top rod 68 prevents scoring banner 30 from sagging when anchoring rods 58 are slipped into their respective linear pockets 60, 62. Linear pockets 60, 62, 70 formed into front face 32 by being sewn to the back face 34 leaving linear space between them. Linear pockets 60, 62, 70 may be also formed between the front face 32 and the back face 34 by means of glue, rivets, thermal bonding or other common means of bonding.

CONCLUSIONS, RAMIFICATIONS, AND SCOPE

Accordingly the reader will see that the banner scoring device of this invention can be used by sporting teams to conveniently and easily maintain their score, display their team insignia and organize their team equipment. The scoring banner device being two-sided adds to the enjoyment of a sporting event by displaying the score to both the participants of the event and the spectators. In one embodiment the banner scoring device also adds to the entertainment value of the sporting event by featuring a sound device that when activated provides familiar sports tunes and cheers. A receiver and speaker may also be incorporated into the banner scoring device to provide the feel of a big league game with individual player introductions or play by play announcing. The banner scoring device also incorporates a pocket to place a team mascot toy within so that it can be used to rally the team when it is displayed above the team name. Furthermore the banner scoring device can be displayed in any sporting venue without special attachments, frames or other structures. The banner scoring device can be easily rolled-upon-itself and secured into cylindrical form allowing easy transportation and storage. Finally teams may also use the scoring banner device to raise funds for their team by selling customized advertising space to local and national companies.

Although the description above contains many specificities, these should not be construed as limiting the scope of the invention but as merely providing illustrations of some of the presently preferred embodiments of the invention. For example, the banner may have different shapes, such as oval or circular and the scoring elements may come in variety of shapes and numbers and be positioned in a variety of locations. The utility storage pockets and equipment storage loops may come in a variety of shapes, sizes and number and be positioned in a variety of locations.

Thus the scope of the invention should be determined by the appended claims and their legal equivalents, rather than by the examples given.

I claim:

1. A two-sided, portable scoring banner comprising:

a front face; a back face coupled to said front face; said front face and said back face each comprising a sheet of lightweight, flexible first material capable of being repeatedly rolled-up and straightened out without fracturing; whereby said front face and said back face form a flexible housing;

at least one first window formed in said front face of said housing; at least one second window formed in said back face of said housing, wherein said at least one first window and said at least one second window are aligned with each other allowing at least one composite window to be formed through said housing;

at least one scoring element rotatably coupled to and sandwiched between said front face and said back face, said scoring element having a front surface and a back surface;

said scoring element comprising a sheet of lightweight, flexible second material capable of being repeatedly rolled-up and straightened out without fracturing, whereby said housing and said scoring element coupled therein are together capable of being repeatedly rolled-up and straightened out;

a set of scoring symbols selectively placed on both said front surface and said back surface of said scoring element, such that the same said scoring symbol is displayed through both said at least one first window and said at least one second window, thereby providing a two-sided scoring display;

means to reposition said scoring element within said housing to simultaneously display a selected scoring symbol through both said at least one first window and said at least one second window;

at least one elongated securing means, each said securing means having a proximal end and a distal end, each said proximal end having a first attachment means for attaching said proximal end to said housing; each said distal end having a second attachment means for securing said banner to a variety of support surfaces;

said banner being capable of being rolled up into a relatively compact cylindrical storage configuration, wherein said at least one flexible elongated securing means is adapted to encircle said banner in said storage position, and said first attachment means is engageable with said second attachment means to thereby retain said banner in said storage configuration;

whereby a sports team can attach said scoring banner to a variety of support structures, select and simultaneously display the same presentation of a team score on both said front face and said back face of said scoring banner and, when desired, roll and secure said scoring banner into a compact and rolled form for easy storage and transportation.

* * * * *